US010610710B2

(12) United States Patent
Huseth et al.

(10) Patent No.: US 10,610,710 B2
(45) Date of Patent: Apr. 7, 2020

(54) FALL PROTECTION RADIO FREQUENCY EMERGENCY BEACON

(71) Applicant: Honeywell International Inc., Morris Plains, NJ (US)

(72) Inventors: Steve Huseth, Plymouth, MN (US); Hai Pham, Eden Prairie, MN (US); Michael Seman, Cranberry Township, PA (US); David Joseph Wunderlin, New Hope, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 16/083,867

(22) PCT Filed: Mar. 11, 2016

(86) PCT No.: PCT/US2016/022017
§ 371 (c)(1),
(2) Date: Sep. 10, 2018

(87) PCT Pub. No.: WO2017/155543
PCT Pub. Date: Sep. 14, 2017

(65) Prior Publication Data
US 2019/0070445 A1 Mar. 7, 2019

(51) Int. Cl.
*A62B 35/00* (2006.01)
*A62B 35/04* (2006.01)

(52) U.S. Cl.
CPC ..... *A62B 35/0075* (2013.01); *A62B 35/0025* (2013.01); *A62B 35/04* (2013.01)

(58) Field of Classification Search
None
See application file for complete search history.

(56) References Cited

U.S. PATENT DOCUMENTS 8,325,053 B2 * 12/2012 Flynt ..... A62B 35/0025 182/231
8,675,823 B2 * 3/2014 Hooten ..... A62B 35/04 182/3
9,480,866 B2 * 11/2016 Pollard ..... A62B 35/0075
9,511,245 B2 * 12/2016 Moore, Jr. ..... A62B 35/0075

OTHER PUBLICATIONS

International Search Report and Written Opinion of the Searching Authority in related International Application No. PCT/US2016/022017, dated Nov. 17, 2016, 10 pages.

* cited by examiner

*Primary Examiner* — K. Wong
(74) *Attorney, Agent, or Firm* — Craige Thompson; Thompson Patent Law

(57) ABSTRACT

Embodiments relate generally to systems and methods for quickly detecting a fall and alerting appropriate parties of the fall. A fall protection device may comprise a fall detection module operable to sense when a fall occurs and generate wireless beacon, where the beacon may be received (or picked up) by any number of wireless devices, including wireless gateways, monitoring stations, and mobile devices.

18 Claims, 2 Drawing Sheets

FALL PROTECTION RADIO FREQUENCY EMERGENCY BEACON

CROSS-REFERENCE TO RELATED APPLICATIONS

This application claims the benefit and is a National Stage Entry under 35 U.S.C. 371 of PCT Application Serial No. PCT/US2016/022017 titled "Fall Protection Radio Frequency Emergency Beacon," filed by Huseth, et al. on Mar. 11, 2016.

BACKGROUND

Fall safety equipment may be worn by a variety of workers in elevated work environments. Fall harnesses may involve the safe stopping of a person already falling, and/or restraining a person to prevent falling. Individuals working at height must be protected from fall injury. Some safety harnesses may be used in combination with a shock absorber, which is used to regulate deceleration when the end of a rope or lanyard is reached.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
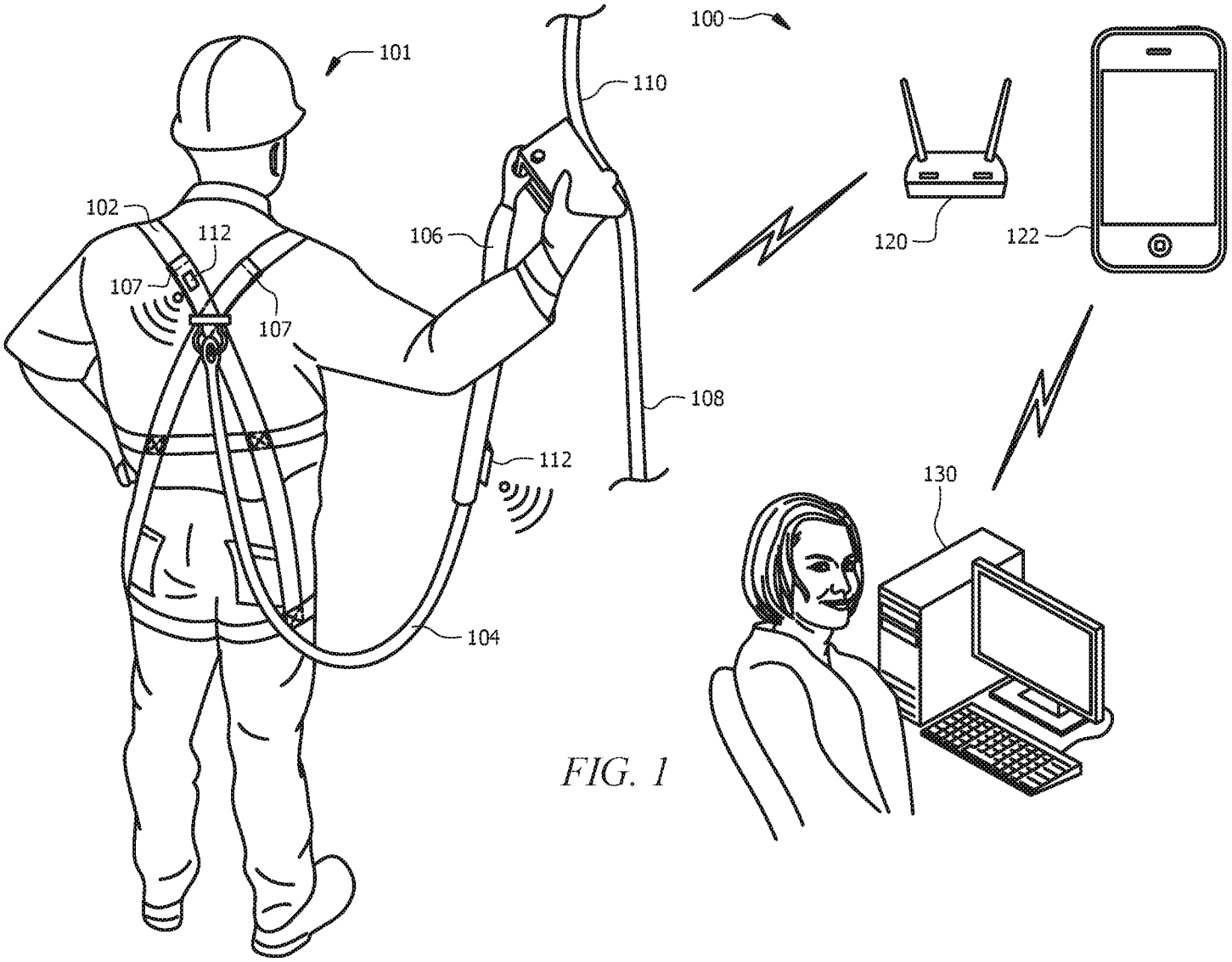
FIG. 1 illustrates a communication system included a fall safety device according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include systems and methods for quickly detecting a fall and alerting appropriate parties of the fall. A fall protection device may comprise a fall detection module operable to sense when a fall occurs and generate wireless beacon, where the beacon may be received (or picked up) by any number of wireless devices, including wireless gateways, monitoring stations, and mobile devices.

Fall harnesses are a critical piece of safety equipment, integral to preventing accidents on a job site. Fall harnesses can provide a reliable restraint system worn by the worker that is connected to a fixed anchor point on a supporting structure. Fall harnesses are designed to arrest the fall of a worker quickly and safely but may result in the worker being suspended in the fall harness. If there is no ladder or scaffolding for the worker to climb back up, the worker may remain suspended until additional rescue help can be rendered. Being suspended in the fall harness for an extended period of time could lead to serious injury to the worker; therefore, rapid response to a fall is critical.

Disclosed herein are systems and methods for alerting in the event of a fall, where a sensor on the fall equipment is operable to automatically and immediately notify responsible parties of the fall event. The use of such a sensor may reduce the response time and therefore the time the person is suspended in the fall equipment.

During a fall, at least a portion of the fall equipment is specifically designed to stretch or expand in reaction to the fall, minimizing the impact of the fall arresting equipment on the person. This expanding or stretching can be sensed by a mechanical switch or sensor. In the event of a fall, the switch may activate a wireless (radio) beacon indicating the fall.

To ensure that the wireless module is functioning correctly and is able to send a message to the emergency personnel or safety officer, the wireless module may periodically wake up and transmit a health status message. In the event of a fall, the sensor detects the fall and communicates with the module, where the module then transmits an emergency signal. The signal may be picked up by a local monitoring device, such as a wireless gateway and/or mobile device, and may be relayed to the appropriate party. If the gateway or mobile device is attached to or carried by the person, additional information may be sensed and included in the alarm message, such as environmental conditions (e.g. temperature), additional motion information confirming the fall, and lack of motion from the person subsequent to the fall.

In actual practice, falls occur rarely. Consequently, any wireless module incorporated into a fall harness should be extremely low power and be operable for long periods without battery replacement. In addition, as with most electronic safety equipment, the wireless radio must be monitored. This requires that the wireless module send out periodic messages. To accomplish this, and also use a minimum of power, the module must be designed to operate in a very low power sleep mode during normal operation. Occasionally, the module wakes up and sends an update (or supervisory message) and then returns to the sleep state.

When a fall event occurs, a sensor (or switch) will be attached or integrated into the stretch points on the fall equipment. These stretch points are typically located within a shock absorber, such as straps that have been sewn in such a manner that the stitching breaks open and expands during the fall. Alternatively, stretching or expanding material might be used requiring the sensor to be integrated at two fixed points such that the stretching activates the switch. The switch (or sensor) consumes no power prior to being activated. When it is activated, it causes an interrupt in the wireless module, waking up the module from its low power state. The module then generates and begins transmitting a fall emergency beacon.

Referring now to FIG. 1, a communication system 100 is shown. A fall safety device 101 may be used when a user is working in an elevated area, or in an area where a fall may occur. The fall safety device 101 may comprise a harness 102 worn on the user's body. The harness 102 may comprise shoulder, waist, back, and/or leg straps. In some embodiments, the harness 102 may attach to a rope or lanyard 104, wherein the lanyard 104 may be attached to the back of the harness 102. Additionally, the lanyard 104 may attach to a secure attachment point 110. In some embodiments, the attachment point 110 may comprise a rope grab 110 operable to attach to and possibly slide along a rope 108.

In some embodiments, the fall safety device 101 may comprise one or more elements 106 and 107 operable to cushion a fall. A shock absorber 106 may be integrated into or attached to the lanyard and may comprise a material operable to stretch and/or expand in the event of a fall, thereby cushioning the fall for the user. In some embodiments, harness may comprise a folded break-away strap 107 that is operable to unfold (and possibly break stitches holding the strap) in response to a fall, thereby cushioning the fall for the user. In some embodiments, the fall safety device 100 may comprise other cushioning elements located on the harness 102 and/or lanyard 104.

In some embodiments, the system 100 may comprise a fall detection module 112 operable to attach to, or be incorporated into, the shock absorber 106. The fall detection module 112 may be operable to sense the stretch and/or expansion of the shock absorber 106, thereby sensing when a fall has occurred. The fall detection module 112 may also be operable to wirelessly communicate with other devices when a fall is detected. For example, the fall detection module 112 may sense stretch or expanding of the shock absorber 106, and then generate a wireless beacon indicating that the user has fallen, where the wireless beacon may be received (or picked up) by other wireless devices in the area. When a fall occurs, the user may be suspended on the lanyard 104 until rescued, so immediate indication of the fall (by the fall detection module 112) may reduce the time the user must stay suspended.

In some embodiments, the communication system 100 may comprise a fall detection module 112 operable to attach to, or be incorporated into, the break-away strap(s) 107 of the harness 102. The fall detection module 112 may be operable to sense the unfolding and/or expansion of the break-away strap 107, thereby sensing when a fall has occurred. The fall detection module 112 may also be operable to wirelessly communicate with other devices when a fall is detected. For example, the fall detection module 112 may sense unfolding or expanding of the break-away strap 107, and then generate a wireless beacon indicating that the user has fallen, where the wireless beacon may be received (or picked up) by other wireless devices in the area. When a fall occurs, the user may be suspended on the lanyard 104 until rescued, so immediate indication of the fall (by the fall detection module 112) may reduce the time the user must stay suspended.

In alternative embodiments, the fall detection module 112 may be operable to attach to, or be incorporated into, another part of the fall safety device 101, such as the harness 102, the lanyard 104, and/or the attachment point between the harness 102 and lanyard 104.

In some embodiment, the fall detection module 112 may be operable to broadcast the wireless beacon to a wireless gateway 120, wherein the beacon may be forwarded to a monitoring station 130. In some embodiments, the wireless beacon may be received by a mobile device 122 carried by the user. The mobile device 122 may be operable to forward the beacon to the monitoring station 130. In some embodiments, the mobile device 122 may also be operable to send additional information with the wireless beacon, such as information collected locally on the mobile device 122. This information may comprise motion data collected by the mobile device, which could include motion before, during, and after the fall. The motion data could verify that a fall has occurred, as well as provide information on the correct status of the suspended user. The additional information may also include location data collected by the mobile device, environmental information (such as temperature), and biological information (such as the user's heart rate).

Figure 2:
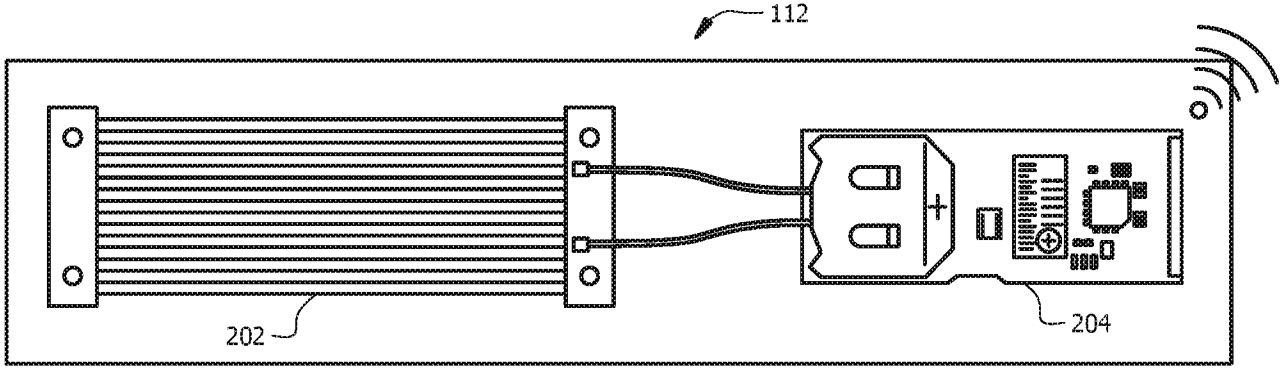
FIG. 2 illustrates a fall detection module according to an embodiment of the disclosure.

As shown in FIG. 2, fall detection module 112 may comprise a sensor 202 and a wireless communication module 204. The sensor 202 may communicate with the wireless module 204 when a fall is detected. Then, the wireless module 204 may generate a wireless beacon that is broadcast by the wireless module 204 to other wireless devices.

In some embodiments, the fall detection module 112 may remain in an unused state for extended amounts of time. While a user is wearing the fall safety device 101, the fall detection module 112 may be in a low power, unused state, and ready to detect a fall and generate a wireless beacon. To ensure that the fall detection module 112 is operating during these long periods of unused time, the fall detection module 112 may periodically generate updates indicating the health and operation of the elements of the fall detection module 112. These updates may be broadcast to other wireless devices, similar to the beacons described above, and forwarded to the monitoring station 130 (in FIG. 1).

Embodiments of the disclosure include a fall safety device comprising a harness operable to be worn on a user's body; an attachment point operable to be attached to a secure structure; a fall cushioning element operable to expand, stretch, or unfold in response to a fall; a sensor attached to the fall cushioning element, wherein the sensor is operable to detect stretching and expanding of the fall cushioning element; a wireless module in communication with the sensor operable to receive data from the sensor indicating a fall and generate a wireless beacon forwarding the sensed information to another wireless device.

In some embodiments, the fall cushioning element comprises a shock absorber located between the attachment point and the harness. In some embodiments, the fall safety device may further comprise a lanyard attached to the harness, wherein the shock absorber is incorporated into the lanyard. In some embodiments, the fall cushioning element comprises a break-away strap located on the harness. In some embodiments, the wireless module may generate a radio beacon operable to be received by any wireless device within the range of the wireless beacon, including mobile devices, wireless gateways, and monitoring stations. In some embodiments, the radio beacon may be received by a mobile device carried by the user. In some embodiments, the mobile device may be operable to forward the radio beacon to a monitoring station, and the mobile device may be further operable to forward additional information to the monitoring station, including motion data collected by the mobile device, location data collected by the mobile device, environmental information, and biological information. In some embodiments, the attachment point may comprise a rope grab and rope. In some embodiments, the sensor and wireless module may be housed together in a fall detection module.

Other embodiments of the disclosure may comprise a method for detecting a fall event comprising sensing a stretch or expand of a fall cushioning element when a fall occurs, wherein the fall cushioning element is part of a fall safety device; receiving the sensed information to a wireless module; generating, by the wireless module, a wireless beacon based on the sensed information; broadcasting the wireless beacon to other wireless devices, wherein the wireless beacon is forwarded to a monitoring station.

In some embodiments, the method may further comprise receiving, by a mobile device carried by a user, the wireless beacon; forwarding, by the mobile device, the wireless beacon to a monitoring station; and sending, by the mobile device, additional user information with the wireless beacon. In some embodiments, the additional user information may comprise one or more of the following: motion data collected by the mobile device, location data collected by the mobile device, environmental information, and biological information. In some embodiments, the method may further comprise, when the fall safety device is worn by a user, and a fall has not occurred, generating an update from the wireless beacon indicating the health and operation of the wireless beacon; and broadcasting the update to other wireless devices, wherein the update is forwarded to a monitoring station. In some embodiments, generating the update may occur periodically throughout the life of the wireless module.

In some embodiments, the fall cushioning element comprises a shock absorber, and the shock absorber may be located between a harness worn by the user and an attachment point of the fall safety device. In some embodiments, the stretch or expand of the shock absorber may be sensed by a sensor attached to the shock absorber. In some embodiments, the fall cushioning element comprises a break-away strap, and wherein the stretch or expand of the break-away strap is sensed by a sensor attached to the break-away strap. In some embodiments, the sensor and wireless module may be housed together as a fall detection module. In some embodiments, the radio beacon may be operable to be received by any wireless device within the range of the wireless beacon, including mobile devices, wireless gateways, and monitoring stations.

Additional embodiments of the disclosure may comprise a method for detecting a fall event comprising periodically generating an update from a fall detection module indicating the health and operation of the fall detection module, wherein the fall detection module may comprise a sensor and a wireless module; broadcasting the update to other wireless devices, wherein the update may be forwarded to a monitoring station; sensing, by the sensor of the fall detection module, a stretch or expand of a fall cushioning element when a fall occurs, wherein the fall cushioning element is part of a fall safety device; receiving the sensed information to the wireless module; generating, by the wireless module, a wireless beacon based on the sensed information; and broadcasting the wireless beacon to other wireless devices, wherein the wireless beacon is forwarded to a monitoring station.

In some embodiments, the method may further comprise receiving, by a mobile device carried by a user, the wireless beacon; forwarding, by the mobile device, the wireless beacon to a monitoring station; and sending, by the mobile device, additional user information with the wireless beacon. In some embodiments, the additional user information may comprise one or more of the following: motion data collected by the mobile device, location data collected by the mobile device, environmental information, and biological information. In some embodiments, generating the update may occur periodically throughout the life of the wireless module.

While various embodiments in accordance with the principles disclosed herein have been shown and described above, modifications thereof may be made by someone skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure but should not be constrained by the headings set forth herein.

Use of broader terms such as "comprises," "includes," and "having" should be understood to provide support for narrower terms such as "consisting of," "consisting essentially of," and "comprised substantially of" Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A fall safety device comprising:

a harness operable to be worn on a user's body;

an attachment point operable to attach the harness to a secure structure;

a fall cushioning element operable to be attached to the attachment point through a lanyard, wherein the fall cushioning element is configured to expand, stretch, or unfold in response to a fall;

a sensor attached to the fall cushioning element, wherein the sensor is operable to detect stretching and expanding of the fall cushioning element; and a wireless module in communication with the sensor operable to receive data from the sensor indicating a fall and generate a wireless beacon forwarding sensed information to a wireless device, the wireless device being a mobile device carried by a user, wherein the mobile device is operable to forward an additional information to a monitoring station, the additional information comprising at least one of motion data collected by the mobile device and biological information.

2. The fall safety device of claim 1, wherein the fall cushioning element comprises a shock absorber located between the attachment point and the harness.

3. The fall safety device of claim 2, wherein the shock absorber is incorporated into the lanyard.

4. The fall safety device of claim 1, wherein the fall cushioning element comprises a break-away strap located on the harness.

5. The fall safety device of claim 1, wherein the wireless module generates a radio beacon operable to be received by any wireless device within the range of the wireless beacon, including mobile devices, wireless gateways, and monitoring stations.

6. The fall safety device of claim 5, wherein the radio beacon is received by the mobile device carried by the user, and wherein the mobile device is operable to forward the radio beacon to the monitoring station, and wherein the motion data collected by the mobile device includes motion of the user before, during, and after the fall, and the biological information includes heart rate information.

7. The fall safety device of claim 1, wherein the sensor and wireless module are housed together in a fall detection module.

8. A method for detecting a fall event comprising:

sensing a stretch or expand of a fall cushioning element when a fall occurs, wherein the fall cushioning element is part of a fall safety device;

receiving sensed information to a wireless module;

generating, by the wireless module, a wireless beacon based on the sensed information; and broadcasting the wireless beacon to other wireless devices, wherein the wireless beacon is forwarded to a monitoring station;

receiving, by a mobile device carried by a user, the wireless beacon;

forwarding, by the mobile device, the wireless beacon to the monitoring station; and sending, by the mobile device, additional user information with the wireless beacon, the additional user information comprising one or more of motion data collected by the mobile device, and biological information.

9. The method of claim 8, wherein the motion data collected by the mobile device includes motion before, during, and after the fall, and the biological information includes heart rate information.

10. The method of claim 8 further comprising: when the fall safety device is worn by the user, and the fall has not occurred, generating an update from the wireless beacon indicating health and operation of the wireless beacon; and broadcasting the update to other wireless devices, wherein the update is forwarded to the monitoring station.

11. The method of claim 10, wherein generating the update occurs periodically throughout the life of the wireless module.

12. The method of claim 8, wherein the fall cushioning element comprises a shock absorber, and wherein the stretch or expand of the shock absorber is sensed by a sensor attached to the shock absorber.

13. The method of claim 8, wherein the fall cushioning element comprises a break-away strap, and wherein the stretch or expand of the break-away strap is sensed by a sensor attached to the break-away strap.

14. The method of claim 13, wherein the sensor and wireless module are housed together as a fall detection module.

15. The method of claim 8, wherein the wireless beacon is operable to be received by any wireless device within the range of the wireless beacon, including mobile devices, wireless gateways, and monitoring stations.

16. A method for detecting a fall event comprising:

periodically generating an update from a fall detection module indicating health and operation of the fall detection module, wherein the fall detection module comprises a sensor and a wireless module;

broadcasting the update to other wireless devices, wherein the update is forwarded to a monitoring station;

sensing, by the sensor of the fall detection module, a stretch or expand of a fall cushioning element when a fall occurs, wherein the fall cushioning element is part of a fall safety device;

receiving sensed information to the wireless module;

generating, by the wireless module, a wireless beacon based on the sensed information;

and broadcasting the wireless beacon to other wireless devices, wherein the wireless beacon is forwarded to the monitoring station;

receiving, by a mobile device carried by a user, the wireless beacon; and forwarding, by the mobile device, the wireless beacon to the monitoring station; and sending, by the mobile device, additional user information with the wireless beacon, the additional user information comprising at least one of motion data collected by the mobile device, and biological information.

17. The method of claim 16, wherein the motion data collected by the mobile device includes motion before, during, and after the fall, and the biological information includes heart rate information.

18. The method of claim 16, further comprising: when the fall safety device is worn by the user, and the fall has not occurred, generating an update from the wireless beacon indicating the health and operation of the wireless beacon, wherein generating the update occurs periodically throughout the life of the wireless module; and broadcasting the update to other wireless devices, wherein the update is forwarded to the monitoring station.

* * * * *